United States Patent [19]

Bratcher

[11] Patent Number: 4,609,192

[45] Date of Patent: Sep. 2, 1986

[54] COLLAPSIBLE PORTABLE EXERCISE TABLE

[75] Inventor: James E. Bratcher, Florissant, Mo.

[73] Assignee: BratMck Company, Inc., Florissant, Mo.

[21] Appl. No.: 636,626

[22] Filed: Aug. 1, 1984

[51] Int. Cl.[4] ..... A63B 23/02

[52] U.S. Cl. ..... 272/144; 108/19; 272/145

[58] Field of Search ..... 272/144, 145; 108/1, 108/19, 156, 130, 35, 112, 116, 124, 158; 248/188, 439

[56] References Cited

U.S. PATENT DOCUMENTS

| | | | |
|---|---|---|---|
| 1,675,827 | 7/1928 | Shrader | 108/156 |
| 3,136,269 | 6/1964 | McDonald | 272/144 X |
| 3,315,667 | 4/1967 | Yoder | 128/74 |
| 3,342,485 | 9/1967 | Gaul | 272/145 |
| 3,357,729 | 12/1967 | Krueger | 108/130 |
| 3,516,633 | 6/1970 | Blackwood | 248/188 |
| 3,783,799 | 1/1974 | Dupuis | 108/19 |

*Primary Examiner*—Richard J. Apley
*Assistant Examiner*—John L. Welsh
*Attorney, Agent, or Firm*—Rogers, Howell, Moore & Haferkamp

[57] ABSTRACT

A collapsible, portable exercise table includes a first group of legs for supporting the table in a planar and horizontal orientation for massage, and a second group of table legs for supporting the table in an inclined position as might be used in exercise. The table legs are either collapsible or removable, and a plurality of threaded receptacles are provided along the bottom of the table surface to selectively assemble the table for either usage. The table is constructed of a pair of table halves having a hinge joining them such that the table legs may be folded in or clipped against the table halves and the tables halves folded against one another and fastened together for storage or transportation.

17 Claims, 5 Drawing Figures

FIG. 4.
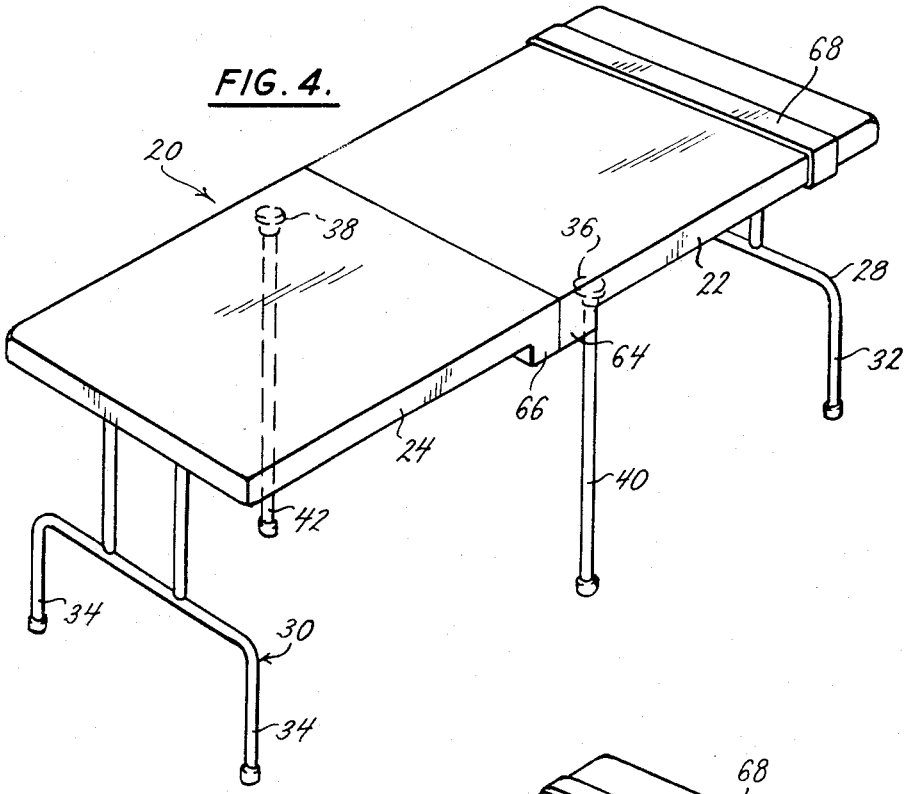
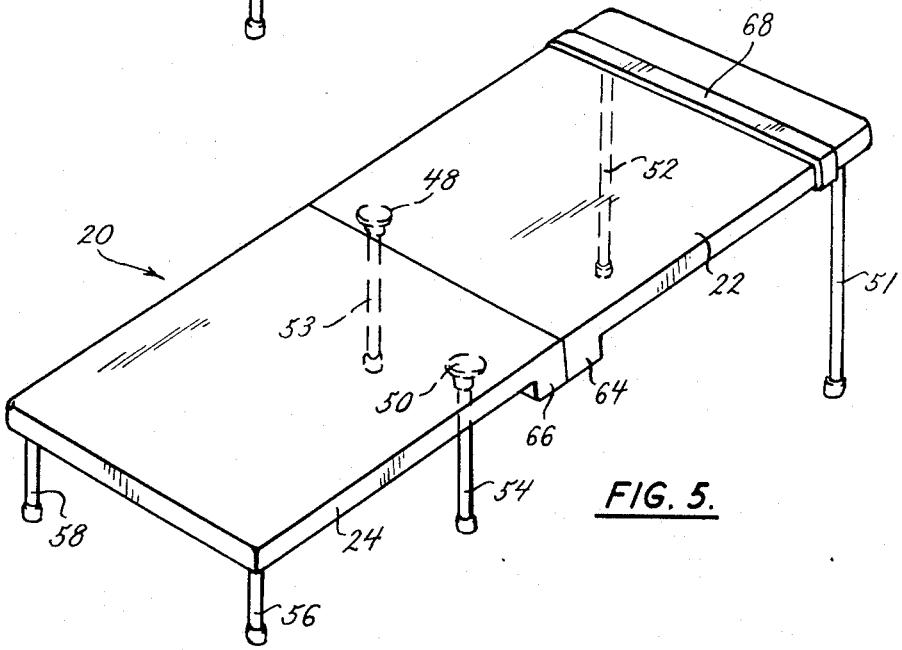
FIG. 5.

COLLAPSIBLE PORTABLE EXERCISE TABLE

BACKGROUND AND SUMMARY OF THE INVENTION

The art of massage is becoming increasingly popular as people become more informed as to the benefits to be derived from a massage. A massage is useful in loosening tight muscles due to overwork or exercise, relieving tension, and to generally improve the feeling of well-being. To facilitate a good massage, it is recommended that the person to be treated be provided with a flat surface on which he can recline, and that the flat surface be somewhat elevated above the floor to eliminate the masseuse having to bend over to reach the various parts of the body being massaged. There are professional massage tables available, and these generally tend to be quite massive with a strong supporting framework and are thus quite heavy. Needless to say, these tables are neither portable nor suitable for home use because of their expense.

Still another trend to be found in the public today is the increasing awareness of physical fitness, and the benefits to be received by toning the body's muscles through exercise. There are complete exercise routines which have been developed which utilize an inclined board or exercise table which the user rests on as he works out. This group of exercises is virtually unlimited in its variety and includes such exercises as sit-ups, leg lifts, side leg lifts, push ups, and others which are well known and which exercise virtually every muscle group in the body. There are presently available incline boards which can be attached to walls, or other supporting structures to facilitate the sit-up exercise. These boards are generally intended to be used on a sharp incline, and almost exclusively for the sit-up exercise. They are generally one piece, and are very inconvenient to transport because of their size.

Not only are these two trends over increasing in polularity, but there are many individuals who are increasingly interested in both trends, and who would be acutely interested in a single table which would be portable, have collapsible and/or removable legs to permit the table surface to be adjusted for the various different positions desired, and which could be folded into a smaller size to facilitate its storage or portability when not in use.

To satisfy this need, and provide a single multi-purpose table which has features permitting it to be used for both massage and for inclined exercise, the inventor herein has succeeded in developing a multi-purpose, collapsible, portable table with a pair of table halves hinged together at an end, with a first group of table legs to support the table in a substantially planar and horizontal orientation for massage, and a second group of table legs to support the table surface in a substantially planar and inclined orientation for exercise, with all of the removable legs and folding legs being adapted for storage along the backs of the table halves such that as the table halves are folded together, all of the legs are enclosed between the table halves and straps can be used to fasten the table halves together.

The first group of legs for supporting the table surface in a substantially planar and horizontal orientation includes a pair of folding legs, each folding leg being hinged to each table half and each folding leg having a pair of leg members to contact the floor in a spaced-apart fashion to provide a wide base for supporting the table during use. Additionally, a pair of removable table legs having the same height as the folding legs may be screwed into threaded receptacles, one receptacle being on either side of the hinge joining the two table halves, and positioned in a diagonal manner across from one another. Thus, the first group of table legs has six different legs contacting the floor, or three legs for each table half with legs immediately adjacent the hinge and on opposite sides thereof to provide additional added support at the hinge.

The second group of legs is comprised of removable table legs which are threaded at one end and screwed into threaded receptacles spaced along the back of the table halves. Each table half has three threaded receptacles for receiving these removable table legs, two at either outside corner, and one at the fourth corner of each table half. Thus, in the incline position, there are six table legs contacting the floor which support the table surface in a sturdy manner as required for exercise. To achieve an incline, each of the six threaded receptacles are canted with respect to the table, every receptacle being canted at substantially the same angle to provide a firm, solid inclined support for exercise purposes.

While a few of the advantages and features of the invention have been described, a greater understanding of the invention may be achieved by reviewing the drawings and reading the description of the preferred embodiment which follows.

BRIEF DESCRIPTION OF THE DRAWINGS

FIG. 4 is an orthogonal view of the table as assembled and unfolded for the massage position; and FIG. 5 is an orthogonal view of the table as assembled and unfolded for the inclined position.

DETAILED DESCRIPTION OF THE PREFERRED EMBODIMENT

Figure 1:
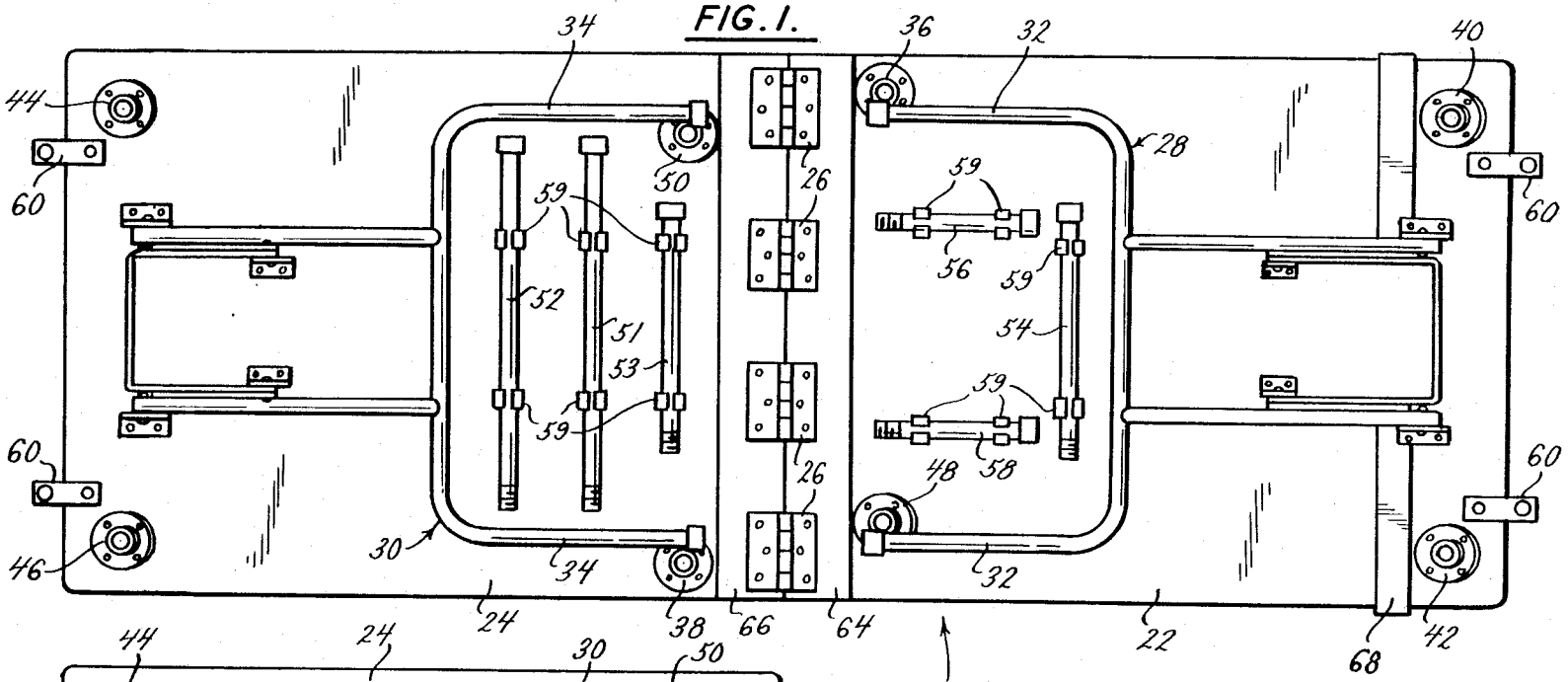
FIG. 1 is a bottom view of the table of the present invention folded open to show the various table legs in the stored position.

The collapsible, portable exercise table 20 of the present invention is shown unfolded in FIG. 1 and includes a pair of table halves 22, 24 which are hinged together at an end by four hinges 26. Each table half 22, 24 has a folding table leg assembly 28, 30, each of which has a pair of legs 32, 34 for contacting the floor. Each table half 22, 24 has a threaded receptacle 36, 38 for receiving a removable table leg 40, 42 to help support the table in the planar and horizontal orientation for massage. As is shown in FIG. 1, threaded receptacles 36, 38 are diagonally positioned from each other across the hinges 26, and are substantially adjacent the outer edge of each table half 22, 24. This increases the lateral base of support for the table 20, which increases the stability of the table in this position. As the table 20 is elevated a greater distance above the floor in the planar, horizontal orientation, this increased width is desirable. Additionally, threaded receptacles 36, 38 are offset from legs 32, 34 to facilitate the collapsing of folding leg assemblies 28, 30 substantially adjacent each table half 22, 24, respectively.

In addition to providing table legs to support the table 20 in the planar horizontal orientation for massage, each table half has two outside threaded receptacles 40, 42, and 44, 46 for supporting the outer ends of each table half 22, 24 in the incline position. Additionally, each table half has an inside threaded receptacle 48, 50 which are diagonally spaced across the hinges 26 and opposite threaded receptacles 36, 38 as shown. As with threaded receptacles 36, 38, threaded receptacles 48, 50 are offset from the table legs 32, 34 to facilitate the folding down of table legs 32, 34 substantially adjacent the table halves 22, 24 for storage. As shown in FIG. 1, each of these threaded supports which are used for the incline position, are canted with respect to the table halves 22, 24. To achieve an incline orientation, table legs 51, 52 are threaded into receptacles 40, 42; table legs 53, 54 are threaded into receptacles 48, 50; and table legs 56, 58 are threaded into receptacles 44, 46. Each of table legs 51, 52, 53, 54, 56, and 58 are held in place for storage by suitable spring clips 59.

Figure 2:
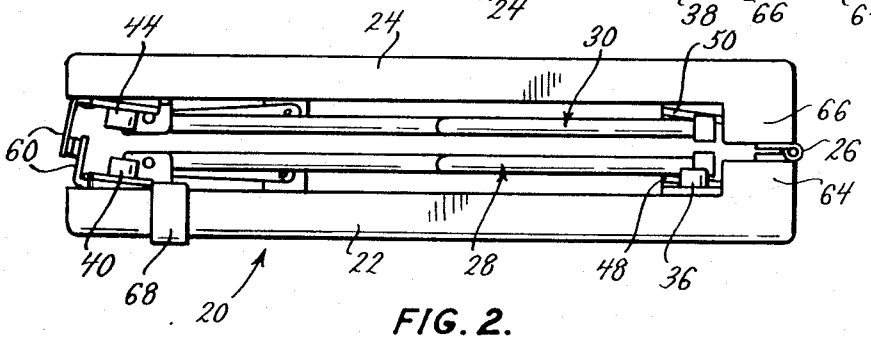
FIG. 2 is a side view of the table folded closed and fastened for storage or transport.

Table 20 is shown collapsed and ready for storage or transport in FIG. 2. Fastening straps 60 are used to fasten together the table halves 22, 24 as they are folded together.

Figure 3:
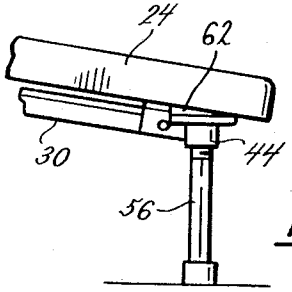
FIG. 3 is a partial view of a single removable leg threaded into a canted receptacle in the inclined orientation.

Shown in FIG. 3 is a threaded receptacle, either 44 or 46, and it includes a triangular shaped spacer block 62 which provides the angle or cant to support the table half 24 for the incline position. Table legs 56 or 58 is shown threaded into receptacle 44 or 46 as it would be assembled for the incline position.

The table 20 is shown in FIG. 4 as completely assembled and ready for use in the massage position. As can be seen, folding leg assemblies 28, 30 have been extended and removable legs 40, 42 have been threaded into receptacles 36, 38. As is shown more clearly in FIGS. 2 and 4, each table half 22, 24 has a thicker portion 64, 66 which helps support the hinge 26 and gives each table half 22, 24 more surface to withstand the torque between table halves 22, 24 as the table 20 is unfolded for use in its flat planar orientation.

As shown in FIG. 5, the table 20 is set up for use in the incline position and has removable legs 56, 58 installed, removable legs 53, 54 installed and, removable legs 40, 42 installed. Additionally, FIG. 5 shows the foot strap 68 which extends across the elevated portion of the inclined table 20 and which can be used by sliding one's feet beneath the strap and between it and table half 22.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. A multi-purpose, collapsible, portable exercise table, said table comprising a pair of padded table halves, a hinge means joining an end of each table half together so that as the table halves are folded open they are substantially aligned, a first group of table legs to support the table in a substantially planar and horizontal orientation, a second group of table legs to support the table in a substantially planar and inclined orientation, at least some of the legs being removable to permit said table to be alternatively supported in one or the other of its said orientations and to permit said table halves to be folded together about the hinge means when not in use, and at least one of said table halves having means to receive and hold said removable legs in a first orientation for supporting the table half and in a second orientation for storage, said removable table legs when in the stored orientation permitting said table halves to be folded together about the hinge means.

2. The table of claim 1 wherein each table half has means to receive and hold a removable leg for supporting the table half in the horizontal orientation, said leg receiving means for each half being near the hinge means and diagonally positioned with respect to the other leg receiving means.

3. The table of claim 2 wherein each table half has means to receive and hold a removable leg for supporting the table half in the inclined orientation, said inclined leg receiving means for each half being near the hinge means, and diagonally positioned with respect to the other inclined leg receiving means.

4. The table of claim 3 wherein each table half has means to receive and hold a removable table leg for the inclined position at each of two additional positions, said additional positions being substantially near the outer two corners of each half away from the hinge means.

5. The table of claim 4 wherein the first group of legs includes a folding leg secured to each table half, each said folding leg having means to fold out to support the table, and fold into a position substantially adjacent the table half for storage to permit said table halves to be folded togther about the hinge means.

6. The table of claim 5 wherein each removable leg receiving means comprises a threaded receptacle.

7. The table of claim 6 further comprising means to cant each removable leg receiving means for the inclined position with respect to its associated table half, said removable leg receiving means for the inclined position all being canted at substantially the same angle.

8. The table of claim 7 further comprising a strap extending across the top of one table half, said strap being adapted to secure a person's feet as they are placed between the strap and table half.

9. The table of claim 8 further comprising clip means secured to each table half to receive and hold each said removable leg in a stored orientation so that said table halves may be folded together about the hinge means as the removable legs are stored herein.

10. The table of claim 9 further comprising a fastener means secured to each table half end opposite the hinge means to fasten the table halves together as they are folded against each other.

11. A multi-purpose, collapsible, portable exercise table, said table comprising a pair of padded table halves, a hinge means joining an end of each table half together so that as the table halves are folded open they are substantially aligned, a first group of table legs to support the table in a substantially planar and horizontal orientation, said first group comprising a pair of foldable table legs, one of each pair being secured to each table half, and a pair of removable legs, means to receive and hold a removable leg mounted to each table half, said removable leg receiving means comprising a threaded receptacle and being positioned substantially near the hinge means and diagonally from each other, and a second group of table legs to support the table in a substantially planar and inclined orientation, said second group being comprised entirely of removable legs, each table half having means to receive and hold three removable legs for the inclined orientation, each said leg receiving means comprising a threaded receptacle, said leg receiving means being positioned near the outer two corners of each table half and the corner of each table half adjacent the hinge means which is not occupied by the horizontal leg receiving means.

12. The table of claim 11 wherein the removable leg receiving means are offset with respect to the folding leg means to facilitate the folding of each folding leg against its associated table half in a compact manner.

13. The table of claim 12 further comprising fastening means secured to each table half end opposite the hinge means to fasten the table halves together as they are folded against each other.

14. The table of claim 13 wherein each table half is substantially thicker near the hinge means to provide added strength thereto.

15. The table of claim 14 further comprising means to cant each removable leg receiving means for the inclined position with respect to its associated table half, said removable leg receiving means for the inclined position all being canted at substantially the same angle.

16. The table of claim 15 further comprising a strap extending across the top of one table half, said strap being adapted to secure a person's feet as they are placed between the strap and table half.

17. The table of claim 16 further comprising clip means secured to each table half to receive and hold each said removable leg in a stored orientation so that said table halves may be folded together about the hinge means as the removable legs are stored therein.

* * * * *